US007357221B2

(12) United States Patent
Maier

(10) Patent No.: US 7,357,221 B2
(45) Date of Patent: Apr. 15, 2008

(54) EXHAUST GAS MUFFLER

(75) Inventor: Georg Maier, Kernen i.R. (DE)

(73) Assignee: Andreas Stihl AG & Co. KG (DE)

( * ) Notice: Subject to any disclaimer, the term of this patent is extended or adjusted under 35 U.S.C. 154(b) by 180 days.

(21) Appl. No.: 10/913,039

(22) Filed: Aug. 5, 2004

(65) Prior Publication Data

US 2005/0029039 A1 Feb. 10, 2005

(30) Foreign Application Priority Data

Aug. 7, 2003 (DE) ..... 103 36 175

(51) Int. Cl.
*F01N 7/00* (2006.01)

(52) U.S. Cl. ..... 181/268; 181/231; 181/229; 181/230; 181/249

(58) Field of Classification Search ..... 181/231, 181/229, 230, 249, 251, 255, 257, 258, 269, 181/272, 275, 282, 268, 274, 279, 280; 60/274, 60/282, 299, 302
See application file for complete search history.

(56) References Cited

U.S. PATENT DOCUMENTS 3,073,684 A * 1/1963 Williams, Sr. ..... 422/175
3,577,728 A * 5/1971 Von Brimer et al. ..... 60/283
4,119,174 A * 10/1978 Hoffman ..... 181/231
4,890,690 A 1/1990 Fischer et al.
5,771,682 A * 6/1998 Simons ..... 60/274
6,109,026 A * 8/2000 Karlsson et al. ..... 60/302
6,164,066 A * 12/2000 Sakaguchi et al. ..... 60/302
6,341,662 B1 * 1/2002 Karlsson ..... 181/230
6,379,411 B1 * 4/2002 Turner et al. ..... 55/394
6,393,835 B1 * 5/2002 Stoll et al. ..... 60/299
6,679,351 B2 * 1/2004 Cummings et al. ..... 181/212
6,715,583 B2 * 4/2004 Santos ..... 181/251
6,789,644 B2 * 9/2004 Mukaida ..... 181/272
7,073,626 B2 * 7/2006 Weinhold et al. ..... 181/279
2002/0116919 A1 * 8/2002 Rosel et al. ..... 60/285

FOREIGN PATENT DOCUMENTS

JP 6-248940 * 9/1994
JP 2004257370 * 9/2004

* cited by examiner

*Primary Examiner*—Lincoln Donovan
*Assistant Examiner*—Forrest Phillips
(74) *Attorney, Agent, or Firm*—Robert W. Becker; Robert W. Becker & Assoc.

(57) ABSTRACT

An exhaust gas muffler is provided for an internal combustion engine, especially for an internal combustion engine in a manually-guided implement such as a power saw, a cut-off machine, or the like. The muffler has a housing having an inlet for exhaust gases and an outlet out of the housing. To achieve an after burning of exhaust gas in a straightforward manner, the exhaust gases in the housing flow through a reaction zone in which the exhaust gases circulate at least partially.

23 Claims, 6 Drawing Sheets

Fig. 4
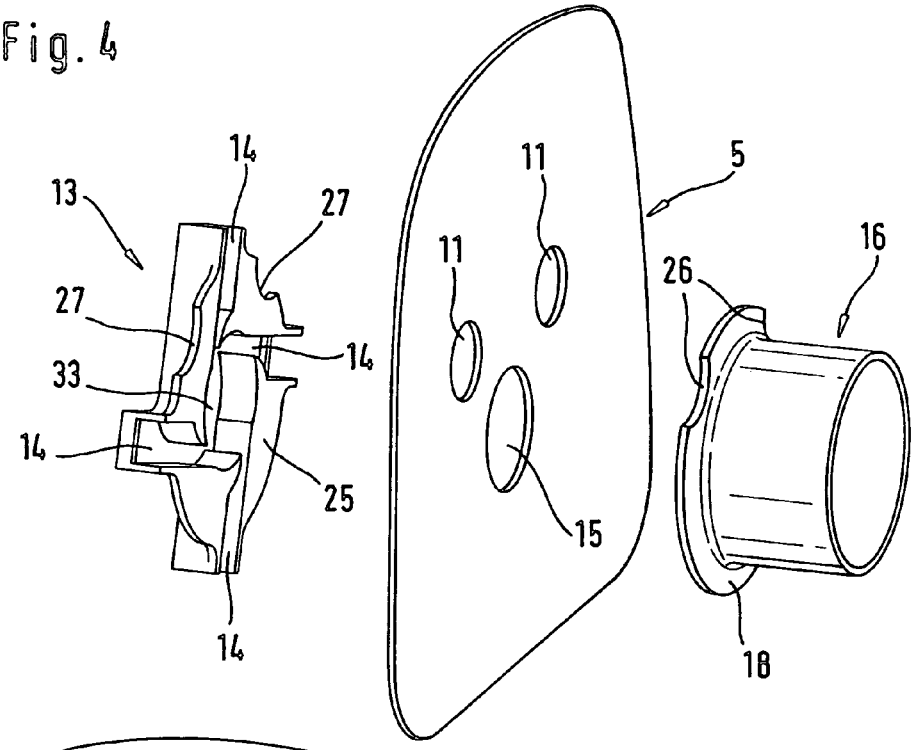
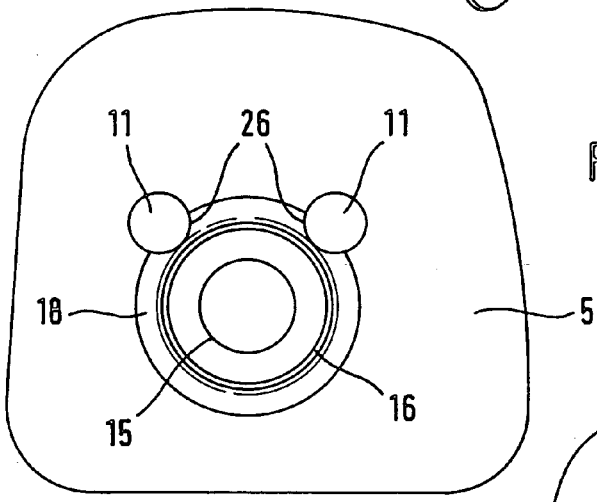
Fig. 5
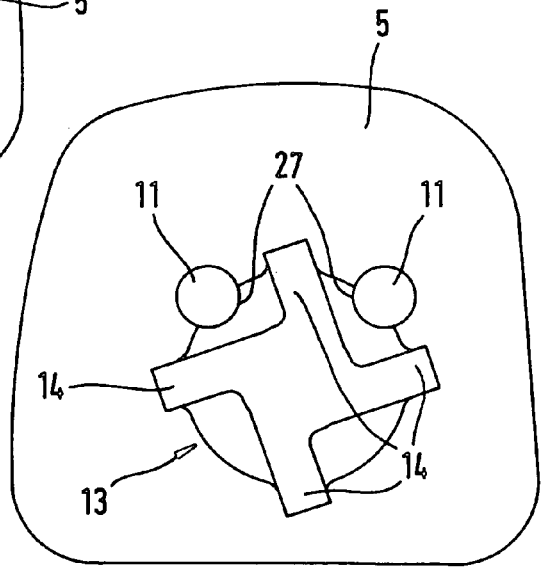
Fig. 6

Fig. 7
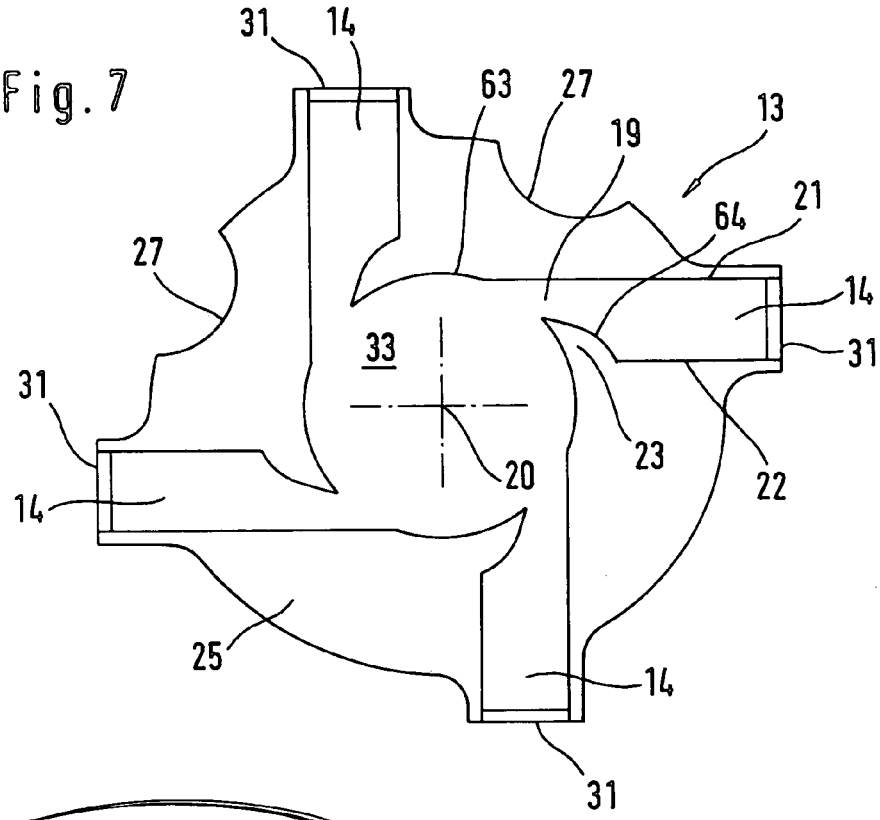
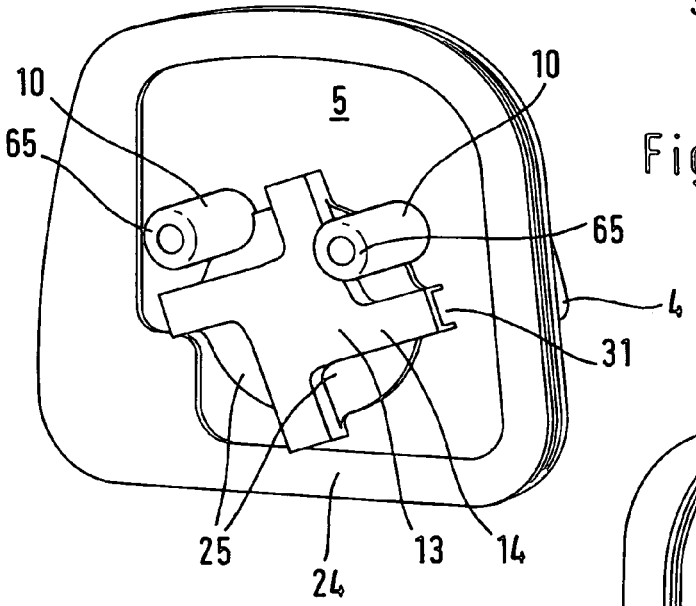
Fig. 8
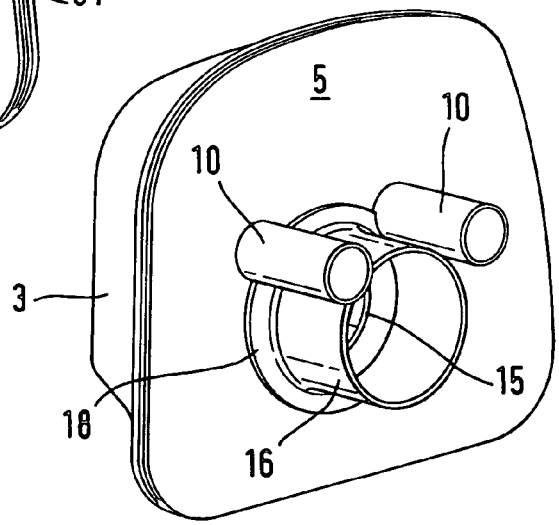
Fig. 9

EXHAUST GAS MUFFLER

BACKGROUND OF THE INVENTION

The present invention relates to an exhaust gas muffler for an internal combustion engine, especially for the internal combustion engine in a manually-guided implement such as a power saw, a cut-off machine, or the like.

An exhaust gas muffler is disclosed in U.S. Pat. No. 4,890,690. To achieve an adequate exhaust gas quality, a catalytic converter, in which a post treatment of exhaust gas is effected, is disposed in the housing of the exhaust gas muffler between the inlet and the outlet in the direction of flow. Such a catalytic converter leads to an increase in the weight of the exhaust gas muffler, which is a particular drawback in manually-guided implements. At the same time, conventional catalytic converters are susceptible to external influences, such as, for example, the quality of the fuel used for the internal combustion engine. The use of the wrong fuel can lead to destruction of the catalytic converter. Furthermore, the raw materials from which the catalytic converter is made, are rare and expensive.

It is therefore an object of the present invention to provide an exhaust gas muffler of the aforementioned general type that has a low weight and ensures a good exhaust gas quality.

BRIEF DESCRIPTION OF THE DRAWINGS

This object, and other objects and advantages of the present invention, will appear more clearly from the following specification in conjunction with the accompanying schematic drawings, in which:

FIG. 4 is an exploded view of the partition with the swirl generator and the cylinder of FIG. 1;

FIGS. 5 & 6 are plan views upon the partition of FIG. 3;

FIG. 7 is a plan view upon the swirl generator of the exhaust gas muffler of FIG. 1;

FIGS. 8 & 9 are perspective views of the partition of the exhaust gas muffler of FIG. 1;

SUMMARY OF THE INVENTION

Figure 1:
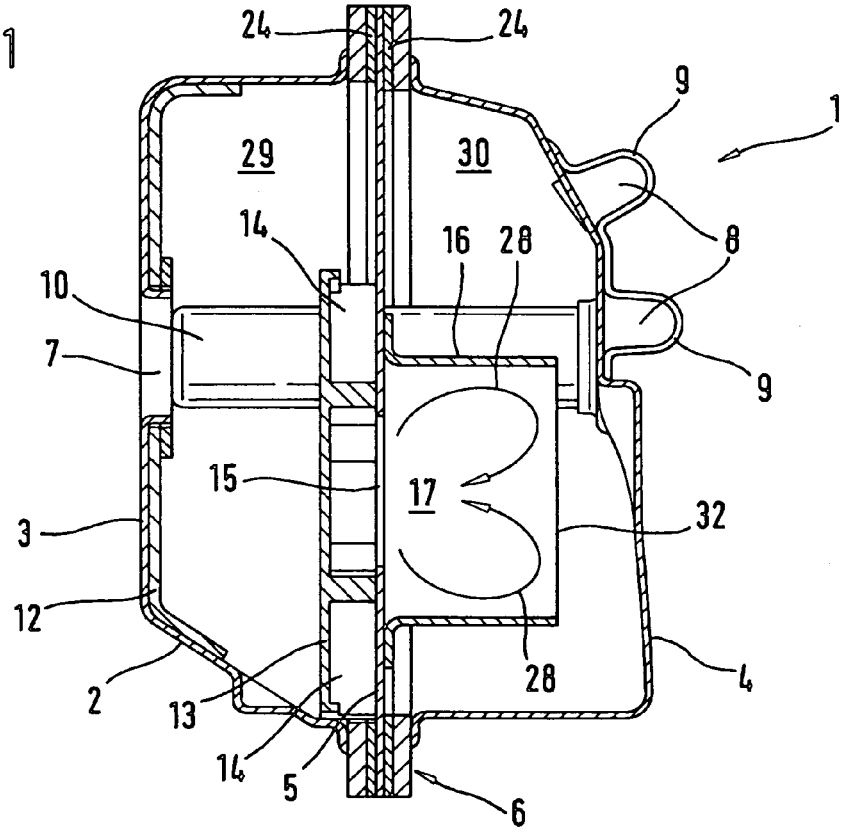
FIG. 1 is a cross-sectional view through one exemplary embodiment of an inventive exhaust gas muffler.

The exhaust gas muffler of the present application comprises a housing having an inlet for receiving exhaust gas from the internal combustion engine, an outlet out of the housing, and a reaction zone, wherein exhaust gas in the housing flows through the reaction zone and circulates at least partially therein.

The exhaust gases that enter the exhaust gas muffler via the inlet have a temperature of about 500° C. To achieve a further chemical conversion of the exhaust gases, a distinct increase in temperature of about 150K to 200K or more must be achieved. To heat the exhaust gases, it is provided that they circulate at least partially in a reaction zone. Due to the circulation of the exhaust gas flow a heating of the exhaust gases flowing in can be achieved. At the same time, the retention time of the exhaust gases in the reaction zone is increased, so that chemical reactions can take place in the reaction zone and the chemical conversion of the exhaust gases occurs. The circulating flow ensures that the reaction partners and intermediate products present in the exhaust gas are thoroughly mixed, so that a conversion can take place.

The exhaust gases advantageously form an annular or ring-shaped flow in the reaction zone. By forming an annular flow, the heat of the circulating exhaust gases can be transferred well to the exhaust gases that are entering, so that an increase in temperature results in the reaction zone. It is provided that successively disposed chambers be formed in the housing in the direction of flow of the exhaust gases, with the chambers being separated from one another by a partition. The reaction zone is advantageously disposed in the region of the partition.

To achieve the circulating flow, a swirl generator is expediently provided that has at least one feed channel that opens tangentially into the reaction zone. By means of the tangentially opening feed channel, a circulating flow is produced in the reaction zone. A plurality of feed channels, in particular four, expediently open in a rotationally symmetrical manner into the reaction zone. A straightforward configuration results if the swirl generator is disposed on the partition. To achieve a good deflection of the exhaust gases in the reaction zone, and to prevent exhaust gases in the reaction zone from mixing with exhaust gases from surrounding regions, it is provided that the reaction zone be delimited by a cylinder that is fixed in position on the partition. The annular flow is in this connection advantageously designed such that the exhaust gases from the inlet first flow along the cylinder wall and are then deflected and then flow back in the interior of the cylinder, in the direction toward the inlet opening, in a direction opposite to the flow along the cylinder wall. Due to the fact that the exhaust gases flow along the cylinder, they are heated thereby. Subsequently flowing-in exhaust gases are heated along the warm cylinder wall. As a result, an introduction of heat to the flowing-in exhaust gases can be achieved. A recirculation takes place due to the flow that is guided along the wall. In this connection, the cylinder is in particular open toward the second chamber.

The reaction zone is expediently essentially closed off, and at least one inlet opening leads into the reaction zone and at least one discharge opening leads out of the reaction zone. In this connection, the inlet opening and the discharge opening are advantageously offset relative to one another in a direction transverse to the direction of flow in the reaction zone. As a result, a high circulation rate of the exhaust gases in the reaction zone can be achieved, since the exhaust gases cannot flow directly from the inlet opening into the discharge opening. A straightforward configuration of the exhaust gas muffler is achieved if the reaction zone is delimited by two half shells. A good flow guidance, with little pressure loss, can be achieved if the half shells have an at least partially bulged configuration. In order for the exhaust gas muffler to have few individual components, it is provided that one half shell be monolithically formed with the partition. One half shell is advantageously fixed in position on the partition.

However, it can also be expedient for the reaction zone to be delimited by a ring that is closed off at its end faces.

To ensure that the exhaust gases in the reaction zone chemically react with one another, it can be expedient for at least one wall that delimits the reaction zone to be coated with a catalytic material. The catalytic coating initiates reactions in the reaction zone, and thus leads to an increase in temperature that starts the further conversion. There is advantageously disposed in the reaction zone an element that is coated with a catalytic material or is comprised of a catalytic material. The element can, for example, be a wire mesh or a grate. The wall of an in flow region to a reaction zone is expediently coated with a catalytic material. However, it can also be expedient to heat the exhaust gas prior to the reaction zone as viewed in the direction of flow. For this purpose, at least one preliminary catalytic converter is advantageously disposed in the direction of flow ahead of the reaction zone.

Further specific features of the present application will be described in detail subsequently.

DESCRIPTION OF SPECIFIC EMBODIMENTS

Referring now to the drawings in detail, the exhaust gas muffler 1, which is illustrated in cross-section in FIG. 1, is provided with a housing 2 that is formed of a lower half 3 and an upper half 4. The two half shells 3, 4 are interconnected at an edge 6. A partition 5 is held at the edge 6 between the two half shells 3, 4. A respective sealing means 24 is disposed on both sides of the partition 5, at the edge 6, between each half shell 3, 4 and the partition 5. However, the edge 6 can also be flanged over without providing a sealing means. The partition 5 separates a first chamber 29 from a second chamber 30. In the lower half 3, the inlet 7 is formed in the housing 2. The outlet 8 leads out of the second chamber 30, and is formed on two hoods 9. At that side facing the internal combustion engine, the lower half 3 is provided with a reinforcing plate 12 for increasing the stability of the exhaust gas muffler 1. The exhaust gas muffler 1 is provided with two sleeves 10 that extend through the exhaust gas muffler from the upper half 4 to the lower half 3. By means of the sleeves 10, the exhaust gas muffler 1 is fixed in position on the internal combustion engine, especially by being screwed or bolted thereon.

The partition 5 has an opening 15, in the region of which a reaction zone 17 is formed. On that side of the partition 5 facing the lower half 3, a swirl generator 13 is fixed in position on the partition 5 in the region of the opening 15. Disposed on the opposite side of the partition 15 is a cylinder 16 that is open toward the second chamber 30. The swirl generator 13 and cylinder 16 delimit the reaction zone 17. The exhaust gases flow through the inlet 7 into the first chamber 29, and through feed channels 14 in the swirl generator 13 into the reaction zone 17. The feed channels 14 open tangentially into the reaction zone 17, so that an annular or ring-shaped flow is produced in the reaction zone. In this connection, the exhaust gases flow from the partition 5 along the wall of the cylinder 16. Due to the swirl that is produced, the direction of flow 28 of the exhaust gases in the reaction zone 17 reverses in the region of the open end 32 of the cylinder 16, so that in a central portion of the cylinder 16 the exhaust gases flow back toward the partition 5. As a result, an annular flow is formed. In this connection, the swirl generator 13 and the cylinder 16 are designed such that as great a portion of the exhaust gases as possible circulate in the reaction zone 17, and the pressure loss resulting in the reaction zone is as small as possible. The exhaust gases heat the cylinder 16 during the circulation, so that exhaust gases flowing into the cylinder 16 are heated along the wall of the cylinder and a temperature increase of the exhaust gases results in the reaction zone 17. The partition 5, the swirl generator 13 and/or the wall of the cylinder 16 can be catalytically coated.

Figure 2:
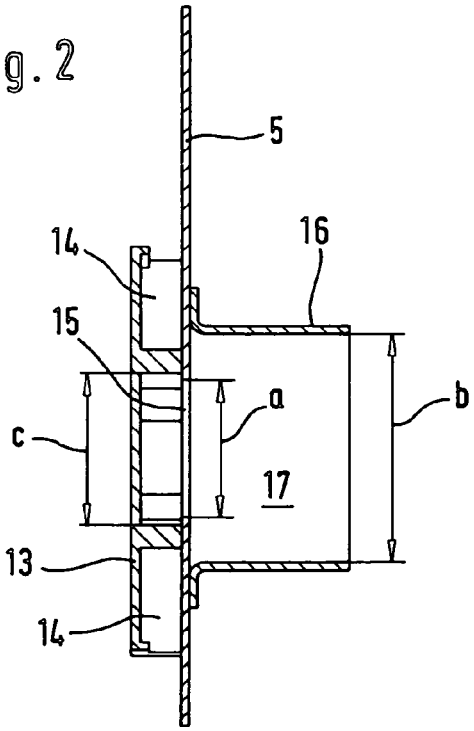
FIG. 2 is a cross-sectional view of the partition of the exhaust gas muffler of FIG. 1.
Figure 3:
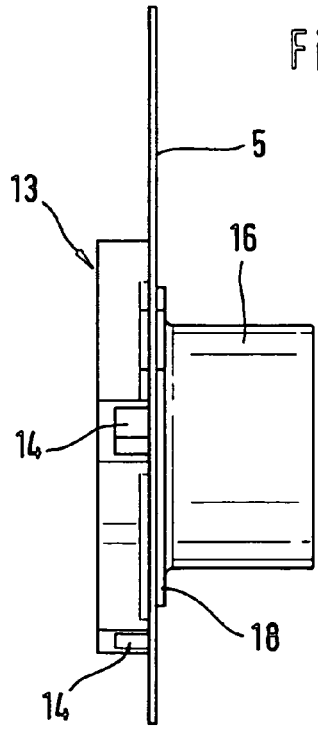
FIG. 3 is a side view of the partition of the exhaust gas muffler of FIG. 1.
Figure 10:
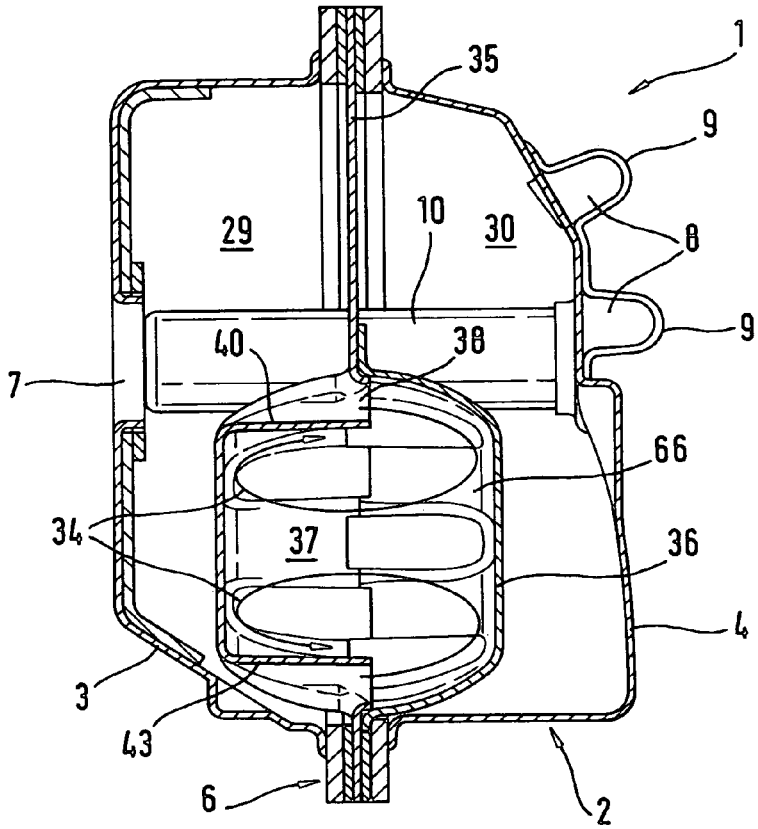
FIG. 10 is a cross-sectional view of an exemplary exhaust gas muffler.

As shown in FIG. 2, the diameter a of the opening 15 is smaller than the diameter c of the portion of the swirl generator 13 that delimits the reaction zone 17. The diameter b of the cylinder 16 is greater than the diameter a of the opening 15 and of the diameter c in the swirl generator 13. However, the diameter a can also be the same as the diameter c. The transition from the swirl generator 13 into the cylinder 16 can also be rounded off or can be embodied as a diffuser. As shown in the side view of FIG. 3, the feed channels 14 have a rectangular or right-angled cross-section. However, the cross-section can also be rounded off. The cylinder 16 is provided with a flange 18 via which it is fixed in position on the partition 5. The cylinder 16 can also be secured to the partition 5 by welding or flanging-over.

As shown in the exploded view of FIG. 4, the feed channels 14 in the swirl generator 13 are open toward the partition 5, and are delimited by the partition itself. The partition 5 is provided with two holes 11 through which the sleeves 10 extend. As also shown in FIG. 5, in the region of the holes 11 the flange 18 is provided with arc-shaped recessed areas 26 for the sleeves 10. The swirl generator 13 has a central region 33 that delimits the reaction zone 17 and at which the feed channels 14 open out. Formed radially beyond the central region 33, between the feed channels 14, is a rim 25 via which the swirl generator 13 rests against the partition 5. As also shown in FIG. 6, in the region of the sleeves 10, i.e. the holes 11, the rim 25 is provided with arc-shaped recessed areas 26.

The swirl generator 13 is shown enlarged in FIG. 7. The four feed channels 14 each have an in-flow or inlet opening 31 through which the exhaust gases enter into the feed channels 14. The first wall 21 of the feed channels 14, which wall faces away from the central axis 20 of the central region 33, ends approximately tangentially into the wall 63 of the central region 33. At the opposite, second wall 22, in the region of where it terminates into the central region 33, a respective nose 23 is formed that extends into the feed channel 14, so that in the region of the opening of the feed channels 14 into the central region 33, a respective narrowing or constriction 19 is formed. The wall 64 of the nose 23 that extends into the feed channel 14 is in this connection respectively rounded off, thus resulting in low losses in flow. Due to the tangential opening of the feed channels 14 into the central region 33, a swirl is imparted to the exhaust gases that leads to the formation of an annular flow in the reaction zone 17. To achieve a uniform, low pressure loss acceleration of the exhaust gases in the feed channels 14, it can be expedient for the feed channels 14 to continuously narrow in a direction toward the reaction zone 17. The wall of the feed channels 14 is advantageously coated with a catalytic material.

The upper half 4 and the partition 5 are illustrated in perspective in FIG. 8. The sleeves 10 extend through the partition 5 in a region of the rim 25 of the swirl generator 13. The sleeves 10, at that end thereof that faces the internal combustion engine, are provided with a shoulder 65 against which, for example, the head of a screw or bolt can rest. The sealing means 24 rests upon the partition 5. As shown in FIG. 9, the sleeves 10 are disposed in the region of the flange 18 of the cylinder 16.

Figure 11:
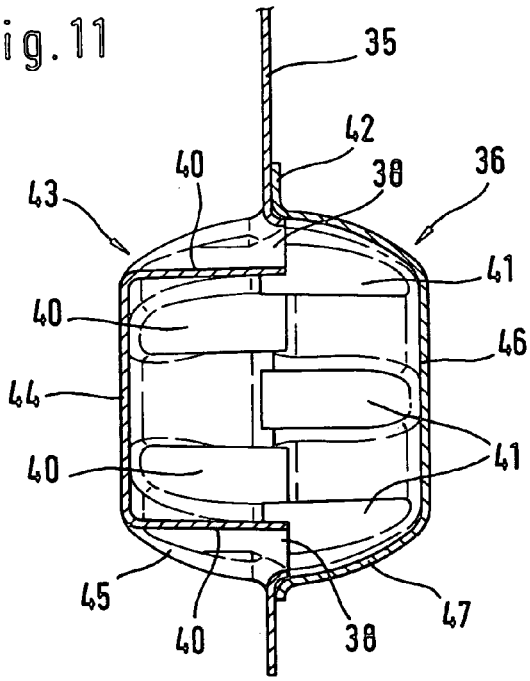
FIG. 11 is a cross-sectional view of the partition of the exhaust gas muffler of FIG. 10.

FIGS. 10 to 15 show an embodiment of an exhaust gas muffler 1, whereby the same reference numerals designate the same components as in FIGS. 1 to 9. Between the lower half 3 and the upper half 4, the exhaust gas muffler 1 is provided with a partition 35 that separates the chambers 29 and 30 of the exhaust gas muffler 1 from one another. Formed in the partition 35 is a chamber 66 in, which a reaction zone 37 is formed. The chamber 66 is delimited by two half shells 36, 43. The half shell 43 is monolithically formed with the partition 35. The half shell 43 is provided with recessed areas 40 in its wall 45, which is shown in FIG. 11. The wall 45 extends out of the plane of the partition 35, and is bulged outwardly. Each recessed area 40 opens via an in-flow or inlet-opening 38 into the chamber 66. In the chamber 66 the exhaust gases, in the direction of flow 34 shown in FIG. 10, flow in the form of an annular or ring-shaped flow, and circulate in the reaction zone 37.

Figure 12:
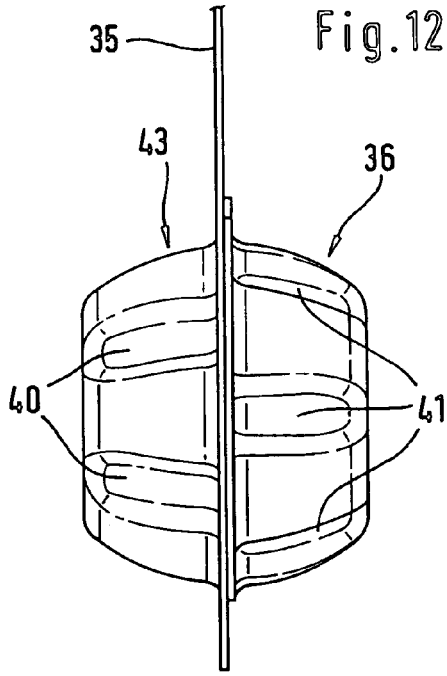
FIG. 12 is a side view of the partition of the exhaust gas muffler of FIG. 10.
Figure 13:
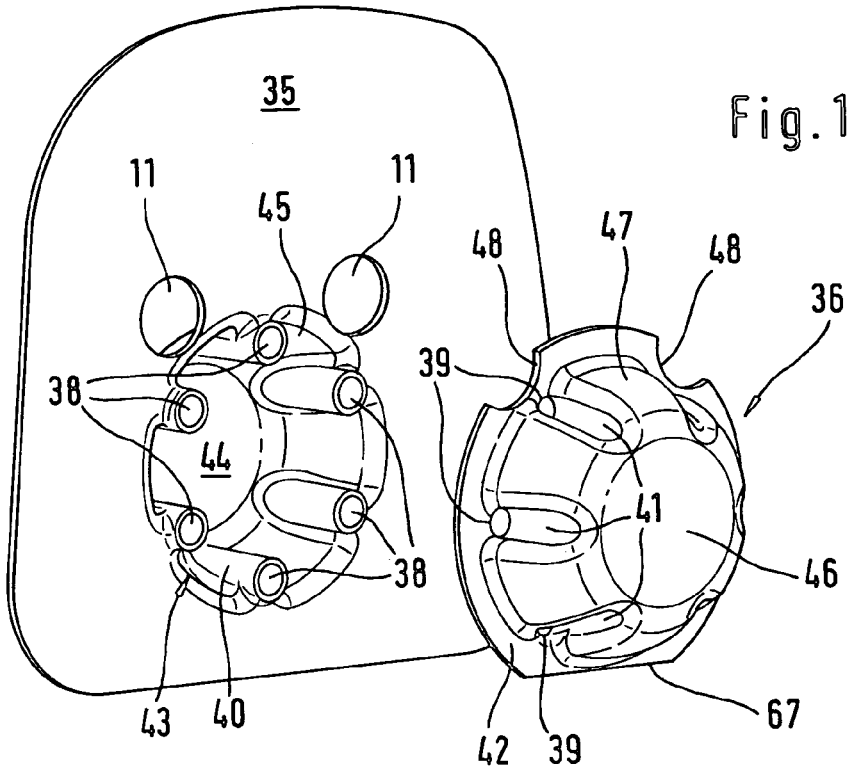
FIG. 13 is an exploded view of the partition of the exhaust gas muffler of FIG. 10.

As shown in FIGS. 11 and 12, the half shell 36 is also provided with recessed areas 41 on its wall 47, which extend out of the plane of the partition 35 on that side of the partition that is opposite the half shell 43. The exhaust gases flow through the inlet opening 38 and along the bulged wall 47 of the half shell 36 to the base 46 of the half shell 36, which base is offset relative to the partition 35 and is disposed approximately parallel thereto. At the base 36, the exhaust gases are deflected toward the middle of the base. In the middle of the base 36, the exhaust gases meet one another from oppositely disposed inlet openings 38, and are deflected in the direction of the half shell 43. There they meet in the region of the middle on the base 44 of the half shell 43, from where they are deflected radially outwardly to the curved walls 45 of the half shell 43. Formed at the recessed areas 41 are the discharge openings 39, which are shown in FIG. 13, and through which the exhaust gases can leave the reaction zone 37. The recessed areas 40 and 41 and the two half shells 43 and 36 have an approximately trough-shaped configuration, whereby the walls that delimit the recessed areas 40 and 41 extend approximately perpendicular to the partition 35. The exhaust gases thus flow in approximately tangentially relative to the wall 47 of the half shell 36, and flow out approximately tangentially relative to the wall 45 of the half shell 43. The half shell 36 has a flange 42 via which it is fixed in position on the partition 35 radially outwardly of the inlet openings 38.

Figure 14:
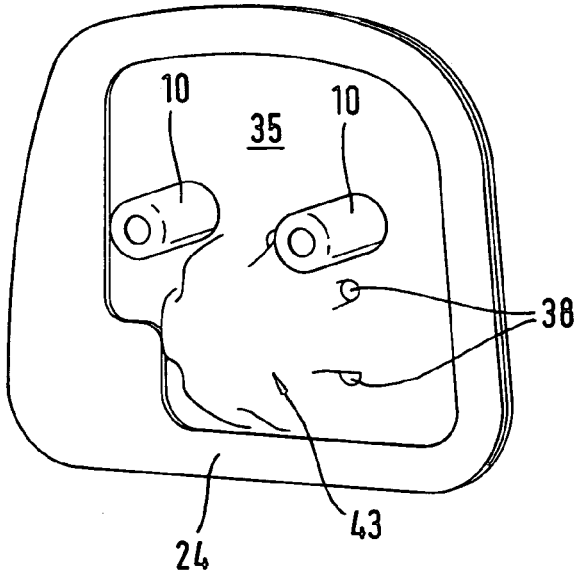
FIGS. 14 & 15 are perspective views of the partition of the exhaust gas muffler of FIG. 10.
Figure 15:
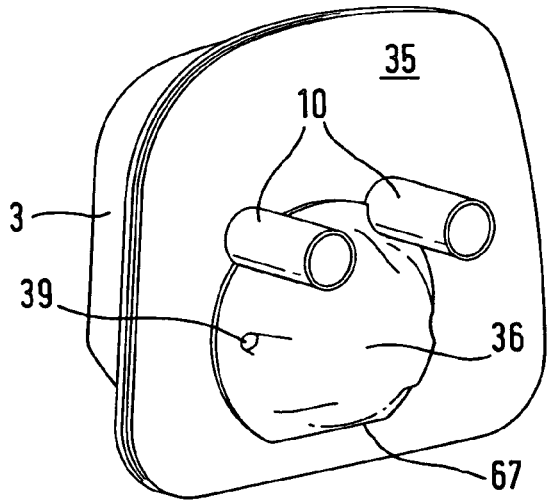

As shown in the exploded view of FIG. 13, the half shell 43, which is monolithically formed with the partition 35, is provided with six inlet openings 38, each of which is formed on a recessed area 40. The half shell 36 has six discharge openings 39, each of which is formed on a recessed area 41. The inlet openings 38 and the discharge openings 39 are offset relative to one another when viewed in a direction transverse to the direction of flow of the exhaust gases, in other words, in the plane of the partition 35. As a result, only a small portion of the exhaust gases can flow directly out of an inlet opening into a discharge opening and can leave the reaction zone 37. The greatest portion of the exhaust gases circulates in the reaction zone 37. To increase the recirculation, the number of inlet openings can be greater than the number of discharge openings. Twice as many inlet openings as discharge openings are advantageously provided. The flange 42 of the half shell 36 is provided with two arc-shaped recessed areas 48 in the region of the holes 11 in the partition 35 for the sleeves 10. On the opposite side, the flange 42 is provided with a flat portion 67 that ensures that the sealing means 24 can rest upon the partition 35. FIGS. 14 and 15 show the partition 35 with the sleeves 10 in perspective illustrations. As shown in FIG. 15, the half shell 36 is spaced from the edge of the partition 35 in the region of the flat portion 67. The inner wall that delimits the reaction zone 37 can advantageously be coated with a catalytic material. However, a wire grid or the like that is coated with a catalytic material can also be disposed in the reaction zone 37.

Figure 16:
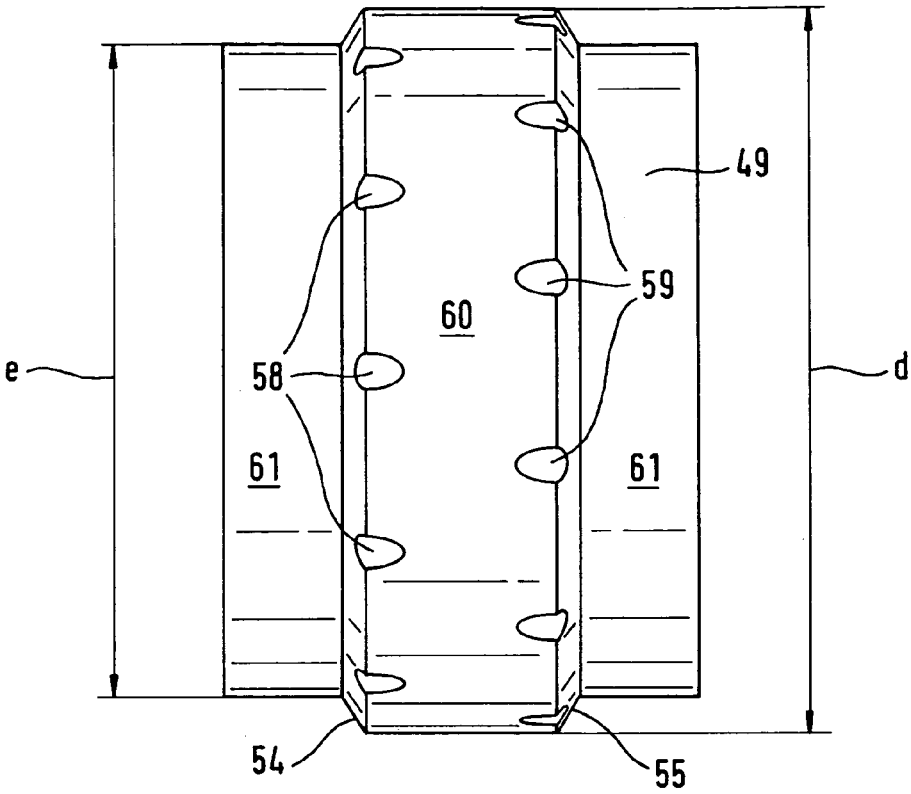
FIG. 16 is a side view of a ring for delimiting the reaction zone of an exhaust gas muffler.
Figure 17:
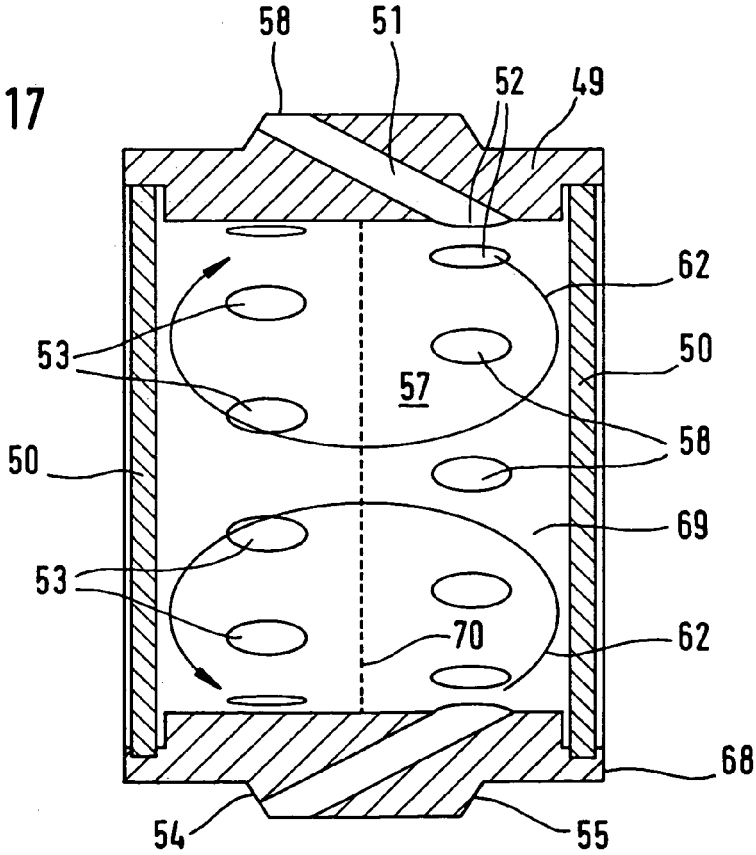
FIG. 17 is a cross-sectional view through the ring of FIG. 16.

FIGS. 16 and 17 show an embodiment or a largely closed reaction zone 57. The reaction zone 57 is formed in a ring 49, which, as shown in FIG. 17, is closed off at its end faces 68 by side walls 50. The ring 49 and the side walls 50 can be disposed in a partition of the exhaust gas muffler 1. The ring 49 has a central portion 60 having a diameter d and on both sides of the central portion 60 has edge portions 61 having a diameter e. In this connection, the diameter e is less than the diameter d. On that side facing a first chamber, the portions 60 and 61 merge with one another at a bevel 54, and on that side facing a second chamber the portions merge with one another at a bevel 55. In the region of the transition of the bevel 54 in the central portion 60, the ring 49 is provided with inlet openings 58. As shown in FIG. 17, a respective channel 51 leads from the inlet openings 58 into the interior of the ring 49 and opens via an in-flow or inlet opening 52 into the interior 69 of the ring 49. As shown in FIG. 16, at the edge between the bevel 55 and the central portion 60 the ring 49 is provided with discharge openings 59. When viewed in the circumferential direction of the ring 49, the discharge openings 59 are offset relative to the inlet openings 58. A total of twelve inlet openings 58 and twelve discharge openings 59 are provided. However, it can be advantageous to have the number of inlet openings greater than, especially twice as great as, the number of discharge openings.

As shown in FIG. 17, the discharge openings 49 open via non-illustrated channels at discharge openings 53 into the interior 69 of the ring 49. Exhaust gases flow through the inlet openings 58 into the channels 51 and the inlet openings 52 into the reaction zone 57, and are deflected at an end or side wall 50. At the wall 50, the exhaust gases flow in a direction toward the middle of the wall 50, where they meet one another and are deflected in a direction toward the opposite end or side wall 50. Upon meeting at the second wall 50, the exhaust gases are deflected in the direction of flow 62 outwardly in a direction toward the ring 49, and pass outwardly through the discharge openings 53 and the discharge openings 59. The ring 49 is fixed in position in a partition of the exhaust gas muffler 1, especially the region of the central portion 60. A large proportion of the exhaust gases circulates in the reaction zone 57, resulting in a temperature increase, whereby the exhaust gases give off heat to the wall of the ring 49 and to the end wall 50, as a result of which exhaust gases that subsequently flow in are heated.

To further increase the temperature of the exhaust gases, it can be expedient to coat at least one of the walls that delimit the reaction zone with a catalytic material. For example, the ring 49 and the side walls 50, or the inner sides of the half shells 36 and 43, can be coated with catalytic material. Disposed in the reaction zone 57 is a grate 70 that is coated with a catalytic material. However, it can also be advantageous to dispose grates having a catalytic material on the side walls 50 and on the inner wall of the ring 49.

Instead of a grate 70, it is also possible to provide a wire mesh or the like. The element, especially the wire mesh or the grate, can also be comprised entirely of a catalytic material.

Similarly, the cylinder shown in FIG. 1 can be catalytically coated. The catalytic coating initiates first reactions, with which energy is released, so that an increase in the temperature of the exhaust gas takes place and further reactions are thus initiated. The catalytic coating thus essentially serves to start the reaction. In this connection, considerably less catalytic material is necessary, than, for example, with a conventional catalytic converter. To achieve an adequate increase in the temperature of the exhaust gas, however, it can also be expedient to heat the exhaust gas in the direction of flow prior to the reaction zone. A heating of the exhaust gas can be achieved in particular by providing a preliminary catalytic converter, which can in particular be disposed in a feed channel 14 of a swirl generator 13. In particular, a preliminary catalytic converter is disposed in each feed channel 14. However, the walls of the feed channels 14 can also be coated with a catalytic material. Since the preliminary catalytic converters merely serve for increasing the temperature, and not for the complete conversion of the exhaust gases, they can be made considerably smaller than are conventional catalytic converters. As a result, the weight is reduced relative to conventional exhaust gas mufflers. At the same time, less catalytic material is required, so that less raw catalytic material is required.

To ensure an adequate hydrocarbon (HC) combustion in the muffler, the combustion conditions must be improved. In this connection, the temperature of the exhaust gases must be increased, the retention time in the reaction zone must be of adequate length, and the intermediate reaction products must be mixed with entering exhaust gas. This can be achieved by reflection of heat, by heat conduction, by convection, or by the use of a preliminary catalytic converter. The reflection of heat by convection can be achieved via a recirculation of the exhaust gases. The circulation of the exhaust gases can thus achieve an adequate HC combustion. The circulation of the exhaust gases is in particular achieved by producing a swirl flow, by flow separations, or by guiding the flow along a wall.

The specification incorporates by reference the disclosure of German priority document 103 36 175.8 filed Aug. 7, 2003.

The present invention is, of course, in no way restricted to the specific disclosure of the specification and drawings, but also encompasses any modifications within the scope of the appended claims.

I claim:

1. An exhaust gas muffler for an internal combustion engine, comprising:

a housing having an inlet for receiving exhaust gas from said internal combustion engine, an outlet, and a reaction zone, wherein exhaust gas in said housing flows through said reaction zone and circulates at least partially in said reaction zone, wherein exhaust gas entering said reaction zone is adapted to be heated so that a chemical conversion of said exhaust gas is adapted to take place, wherein said reaction zone is delimited by a swirl generator and a cylinder, wherein said swirl generator is provided for producing the circulating flow, wherein said swirl generator is provided with at least one feed channel that opens tangentially into said reaction zone, wherein exhaust gas in said swirl generator flows through said at least one feed channel, further wherein said at least one feed channel opens tangentially into said reaction zone such that in said reaction zone, said exhaust gas forms an annular flow, wherein said annular flow is such that said exhaust gas initially flows along a wall of said cylinder and is then deflected such that said exhaust gas then flows back in the interior of the cylinder, in a direction opposite to the flow of said exhaust gas along the wall of said cylinder, toward where said at least one feed channel opens into said cylinder.

2. An exhaust gas muffler according to claim 1, wherein in said housing, as viewed in a direction of flow of exhaust gas, two successively disposed chambers are formed, and wherein a partition is provided that separates said chambers from one another.

3. An exhaust gas muffler according to claim 2, wherein said reaction zone is disposed in a region of sad partition.

4. An exhaust gas muffler according to claim 1, wherein a plurality of teed channels open in a rotationally symmetrical manner into said reaction zone.

5. An exhaust gas muffler according to claim 2, wherein said swirl generator is disposed on said partition.

6. An exhaust gas muffler according to claim 2, wherein said cylinder is fixed in position on said partition, wherein exhaust gas entering said reaction zone is adapted to fox along a wall of said cylinder, and wherein in a central portion of said cylinder said exhaust gas is adapted to flow back.

7. An exhaust gas muffler according to claim 2, wherein said cylinder is open in a direction toward a second one of said chambers.

8. An exhaust gas muffler according to claim 1, wherein at least one wall that delimits said reaction zone is coated with a catalytic material.

9. An exhaust gas muffler according to claim 1, wherein an element is disposed in said reaction zone, and wherein said element is coated with a catalytic material or comprises a catalytic material.

10. An exhaust gas muffler according to claim 1, wherein a wall of an in-flow region to said reaction zone is coated with a catalytic material.

11. An exhaust gas muffler according to claim 1, wherein means are provided for heating said exhaust gas in a direction of flow upstream of said reaction zone.

12. An exhaust gas muffler according to claim 11, wherein said means is at least one preliminary catalytic converter.

13. An exhaust gas muffler according to claim 4, wherein four feed channels open in a rotationally symmetrical manner into said reaction zone.

14. An exhaust gas muffler according to claim 9, wherein said element in said reaction zone is a grate or a wire mesh.

15. An exhaust gas muffler according to claim 1, wherein said swirl generator and said cylinder have a configuration such that a great portion of the exhaust circulates in said reaction zone and pressure loss resulting in said reaction zone is small.

16. An exhaust gas muffler for an internal combustion engine, comprising:

a housing having an inlet for receiving exhaust gas from said internal combustion engine, an outlet, and a reaction zone, wherein exhaust gas in said housing flows through said reaction zone and circulates at least partially in said reaction zone, wherein exhaust gas entering said reaction zone is adapted to be heated so that a chemical conversion of said exhaust gas is adapted to take place, wherein said reaction zone has an essentially closed configuration, wherein at least one inlet opening leads into said reaction zone, wherein at least one discharge opening leads out of said reaction zone, wherein exhaust gas is adapted to flow through said at least one inlet opening into said reaction zone, wherein said inlet and outlet openings are disposed such that exhaust gas in said reaction zone is adapted to flow to a wall and to be deflected at said wall in a direction toward an oppositely disposed wall, and wherein the exhaust gas is adapted to be deflected radially outwardly from a middle of said oppositely disposed wall so that the exhaust gas circulates in said reaction zone in the form of an annular flow.

17. An exhaust gas muffler according to claim 16, wherein a ring is provided that delimits said reaction zone, and wherein end faces of said ring are closed off.

18. An exhaust gas muffler according to claim 17, wherein said ring is provided with at least one inlet opening and at least one discharge opening, and wherein a respective channel formed in said ring opens out at each of said inlet openings and each of said discharge openings.

19. An exhaust gas muffler according to claim 16, wherein in a direction transverse to a direction of flow in said reaction zone, said inlet opening and said discharge opening are offset relative to one another.

20. An exhaust gas muffler according to claim 16, wherein two half shells are provided that delimit said reaction zone.

21. An exhaust gas muffler according to claim 20, wherein said half shells have an at least partially bulged configuration.

22. An exhaust gas muffler according to claim 20, wherein one of said half shells is monolithically formed with said partition.

23. An exhaust gas muffler according to claim 20, wherein one of said half shells is fixed in position on said partition.

* * * * *